US007360627B2

(12) United States Patent
Scott

(10) Patent No.: US 7,360,627 B2
(45) Date of Patent: Apr. 22, 2008

(54) SUPPORT BRACKET SECURABLE TO AN UPWARDLY EXTENDING WALL STUD

(76) Inventor: Loyd Scott, 8991 Big Hand, Columbus, MI (US) 48063

( * ) Notice: Subject to any disclaimer, the term of this patent is extended or adjusted under 35 U.S.C. 154(b) by 1331 days.

(21) Appl. No.: 10/193,958

(22) Filed: Jul. 12, 2002

(65) Prior Publication Data

US 2004/0007423 A1 Jan. 15, 2004

(51) Int. Cl.
*E04G 3/00* (2006.01)

(52) U.S. Cl. ..... 182/82; 182/150

(58) Field of Classification Search ..... 182/82, 182/150

See application file for complete search history.

(56) References Cited

U.S. PATENT DOCUMENTS

| | | | | | |
|---|---|---|---|---|---|
| 2,321,916 | A | * | 6/1943 | Ingerman | 248/248 |
| 3,041,033 | A | * | 6/1962 | Schwartz | 248/248 |
| 3,148,857 | A | * | 9/1964 | Hutchison | 248/247 |
| 3,198,470 | A | * | 8/1965 | Owens | 48/245 |
| 3,363,867 | A | | 1/1968 | Zackrisson | 248/250 |
| 3,385,400 | A | | 5/1968 | Whitsett | 182/150 |
| 3,698,680 | A | * | 10/1972 | Shoemaker | 249/189 |
| 3,776,498 | A | | 12/1973 | Peter et al. | 248/221 |
| 3,970,277 | A | | 7/1976 | Riblet | 248/246 |
| 4,382,571 | A | | 5/1983 | Horen | 248/235 |
| 4,452,336 | A | * | 6/1984 | Sickler | 182/82 |
| 4,793,267 | A | | 12/1988 | Birillo | 108/152 |
| 4,942,940 | A | | 7/1990 | Boeshart | 182/82 |
| 5,156,235 | A | | 10/1992 | Preston | 182/178 |
| 5,303,891 | A | | 4/1994 | Powers | 248/218.4 |
| 5,316,253 | A | * | 5/1994 | Flathau et al. | 248/235 |
| 5,535,974 | A | | 7/1996 | Savitski | 248/246 |
| 5,771,991 | A | | 6/1998 | Fresco | 182/82 |
| 5,865,410 | A | | 2/1999 | Horen | 248/242 |
| 5,918,843 | A | | 7/1999 | Stammers | 248/230.6 |
| 6,053,280 | A | * | 4/2000 | Smith et al. | 182/82 |
| 6,148,957 | A | | 11/2000 | Ahl et al. | 182/117 |
| 6,244,548 | B1 | | 6/2001 | Gillette | 248/210 |
| 2001/0025741 | A1 | * | 10/2001 | Hudson | 182/82 |

* cited by examiner

*Primary Examiner*—Alvin Chin-Shue
(74) *Attorney, Agent, or Firm*—Gifford, Krass, Sprinkle, Anderson & Citkowski, P.C.

(57) ABSTRACT

A support bracket securing to a vertically extending wall stud and providing cantilevered support of a horizontally disposed plank. An elongated and reinforced support surface includes first and second ends. A channeled base extends from the first end and includes first and second spaced apart sides through which are defined aligning apertures. Upon aligning the sides in seating fashion over a selected wall stud, a mounting fastener enters through a selected aperture in the first side, through the wall stud, and exits through a further selected and aligning aperture in the second side. A first abutment stop projects from a first location of the support surface, a second abutment stop projects from a second spaced apart location and defines, in combination with the first stop, a seating area for receiving the plank. In use, at least first and second support brackets secure, respectively, in substantially vertically aligned fashion to a pair of spaced apart wall studs and in order to support, therebetween, the horizontally disposed plank.

13 Claims, 6 Drawing Sheets

SUPPORT BRACKET SECURABLE TO AN UPWARDLY EXTENDING WALL STUD

BACKGROUND OF THE INVENTION

1. Field of the Invention

The present invention relates generally to wall stud mounted support structures. More particularly, the present invention teaches a support bracket incorporating an elongated plank support surface, the bracket including a channeled base particularly configured so as to be secured to a location of an upwardly extending 2"×4" or 2"×6" stud.

2. Description of the Prior Art

The prior art is well documented with examples of scaffolding support brackets, devices and hangers. The usual purpose of such bracket supports is the ability to maintain, once affixed in generally level and spaced apart fashion, an elongate extending plank.

A first example of the prior art is set forth in U.S. Pat. No. 4,382,571, issued to Horen, and which teaches a scaffolding bracket for supporting a platform against the wall of a ship or the like. The bracket includes a tapered U-shaped support beam having opposed pairs of apertures in the sides near one end thereof, the support beam being adjustable relative to a wall engaging plate. The wall engaging plate includes a pair of keyhole apertures which connect to a pair of metallic studs secured to a wall of a ship such as by welding.

The plate in Horen further includes a flange, the opposed sides of which define a segment of a circle about which the support beam is adjustably pivoted. The flange also includes a series of apertures at spaced apart intervals which cooperate with the pairs of apertures nears the end of the support beam, thus allowing the support beam to be pivotably adjusted in increments of five or ten degrees around the circle segment. In order further to permit the bracket to be used on the inside wall as well as the outside wall of a ship, the flange is constructed to define a half circle about which the support beam is adjustably pivoted by a series of spaced apertures therein.

U.S. Pat. No. 5,535,974, issued to Savitski, teaches a scaffold bracket which is removably attachable to an elongated member, again such as the stud of a building under construction. The bracket includes a support structure having a support arm and first and second grippers attached to the support structure. The grippers engage the front and back surfaces of the elongated member, respectively. When the bracket is mounted to the elongated member, the support arm extends substantially horizontally. In this mounted position, a downward force on the support arm causes the first and second grippers to exert a gripping force on the elongated member.

A further collection of prior art patents, directed to scaffolding supports, include Preston 5,156,235, Whitsett 3,385,400 and Flathau et al. Each of these references includes, in addition to horizontal and vertical interconnected and extending components, a diagonally extending strut or reinforcing support.

U.S. Pat. No. 5,303,891, issued to Powers, teaches a bracket for supporting a length of lumber adjacent a vertical member such as a stud. The bracket has a central bar to which a pair of end bars are welded. The end bars extend in both directions away from the central bar. The central bar is then placed adjacent the face of a vertical stud and the end bars are sufficiently separated so that the bracket may be rotated a small amount. The bracket is then and a length of lumber is then inserted between the upper and lower bars in a cantilevered member and held securely so that it may be worked on, such as cut to length, along the cantilevered ends. The process of using the bracket is also disclosed and a bracket having four end bars is also disclosed.

Finally, U.S. Pat. No. 6,148,957, issued to Ahl et al., teaches a ladder supported scaffolding assembly, and one which utilizes two spaced apart ladders placed side by side. The assembly includes a scaffold platform, a ladder attachment bracket being disposed on the opposing ends of the platform. In order to engage a step associated with each of the spaced apart ladders, an upward sloping surface associated with each bracket which releasably engages and secured hooks onto a step from underneath the step.

SUMMARY OF THE PRESENT INVENTION

The present invention is a support bracket incorporating an elongated plank support surface, the bracket including a channeled base particularly configured so as to be secured to a location of an upwardly extending 2"×4" or 2"×6" stud. More specifically, the present invention discloses any plurality of support brackets, arranged in a desired fashion in relation to a like plurality of wall studs, and in order to support horizontally disposed and elongated supports, such as 2"×12" planks.

Each of the support brackets includes an elongated, substantially flattened and reinforced support surface having a first end and a second end. The elongated and reinforced support surface further includes an underneath extending "I" beam portion.

A three dimensional shaped and channeled base extends from the first end of the support surface, the channeled base including first and second spaced apart sides through which are defined aligning apertures. Upon aligning the sides in seating fashion over a selected wall stud, a mounting fastener enters through a selected aperture in the first side, through the wall stud, and exits through a further selected and aligning aperture in the second side.

A tab is secured to the support surface and in upwardly projecting from a first intermediate location. A fitting is secured to an extending end location of the support surface and defines, in combination with the tab, a seating area of the reinforced support surface for receiving, in widthwise inserting and immovable fashion, the plank.

The fitting also is internally recessed for receiving, in vertically seating fashion, an inserting end of an elongated rail support. The rail support further includes a channeled rail support portion for receiving, in seating fashion, a further length of stud operating as a hand rail.

In use, at least first and second support brackets secure, respectively, in substantially vertically aligned fashion to a pair of spaced apart wall studs and in order to support, therebetween, the horizontally disposed walkway plank. The channeled rail support portions create, upon installing the optional rail supports, provides a seating area for affixing the length of stud for use as a hand rail.

Applications of the support brackets include building construction applications, whereby the brackets serve to support a plank in a walkway application and with or without the additional use of the insertable hand rails. Additional applications of the support bracket include using them, in combination with the elongated planks, to provide shelving support either in singular or multiple stacked fashion as well as functioning as a holding rack for storage support of items such as ladders and the like.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
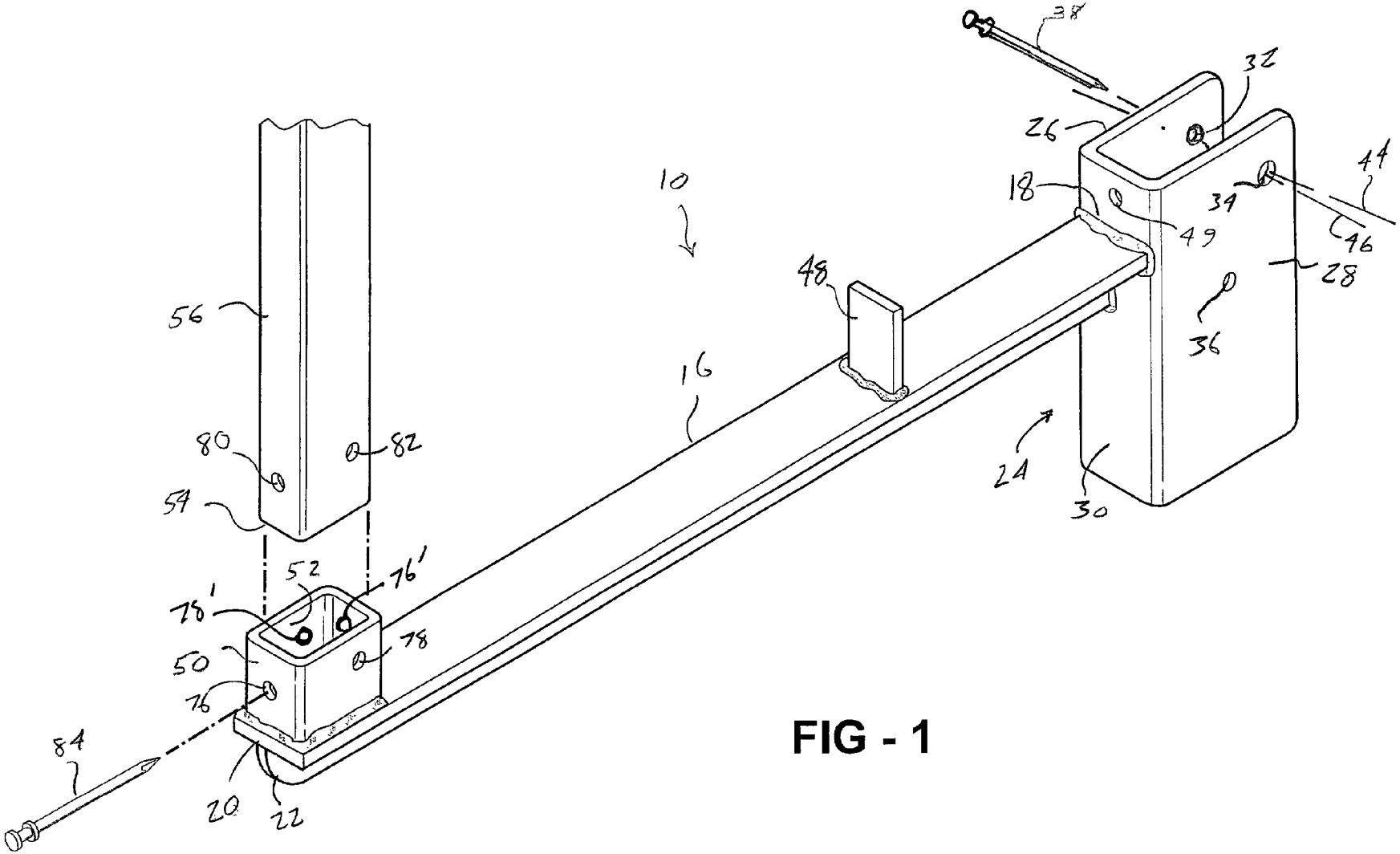
FIG. 1 is a perspective illustration of the support bracket, in partially exploded fashion, and which shows the integrally formed fitting arranged at the extending end of the bracket for receiving, in vertically seating fashion, a hand rail support.
Figure 3:
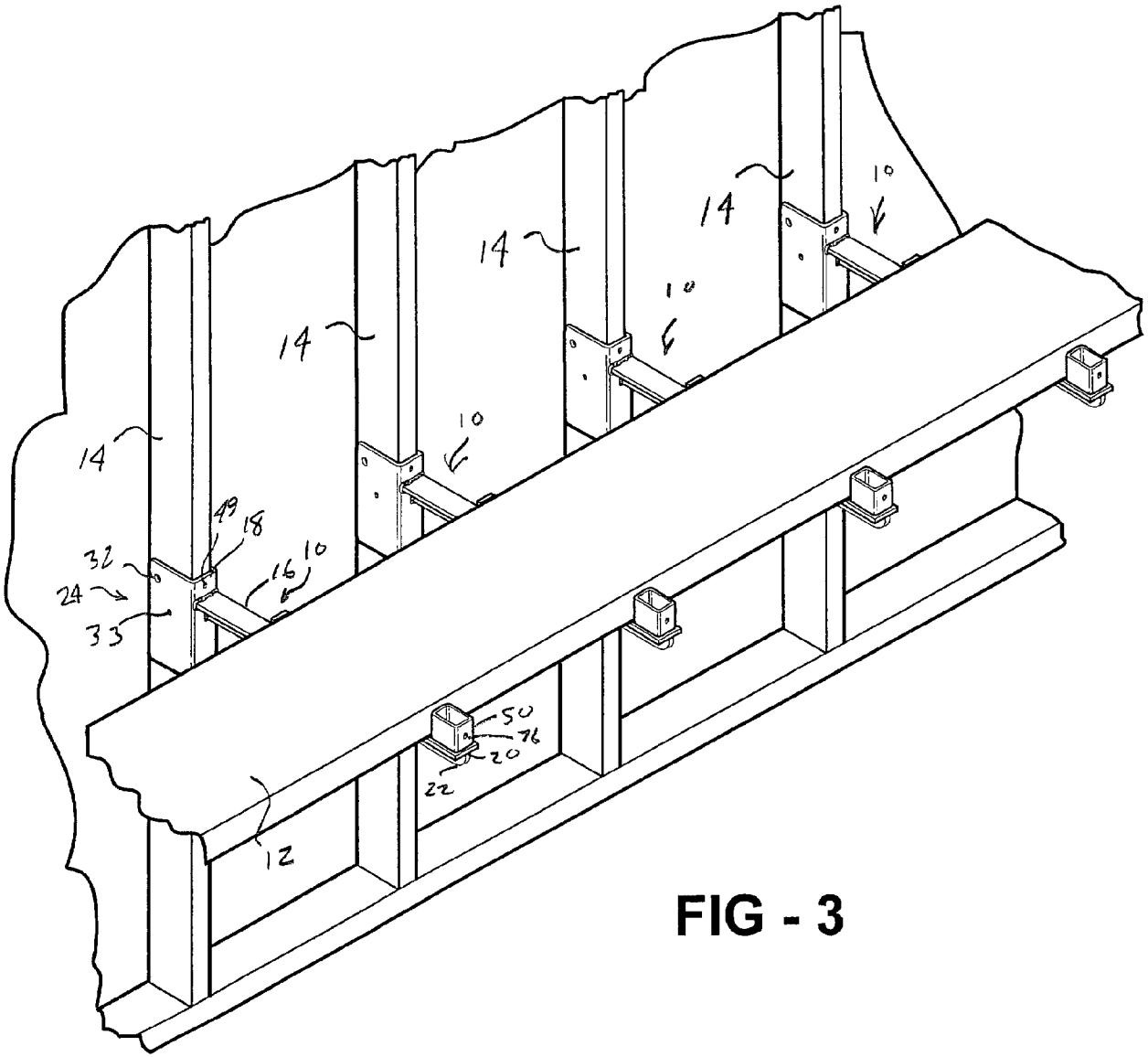
FIG. 3 is an illustration in perspective and showing a plurality of support brackets secured in spaced apart fashion to a like plurality of wall studs and supporting a conventional plank in a walkway application according to the present invention.
Figure 4:
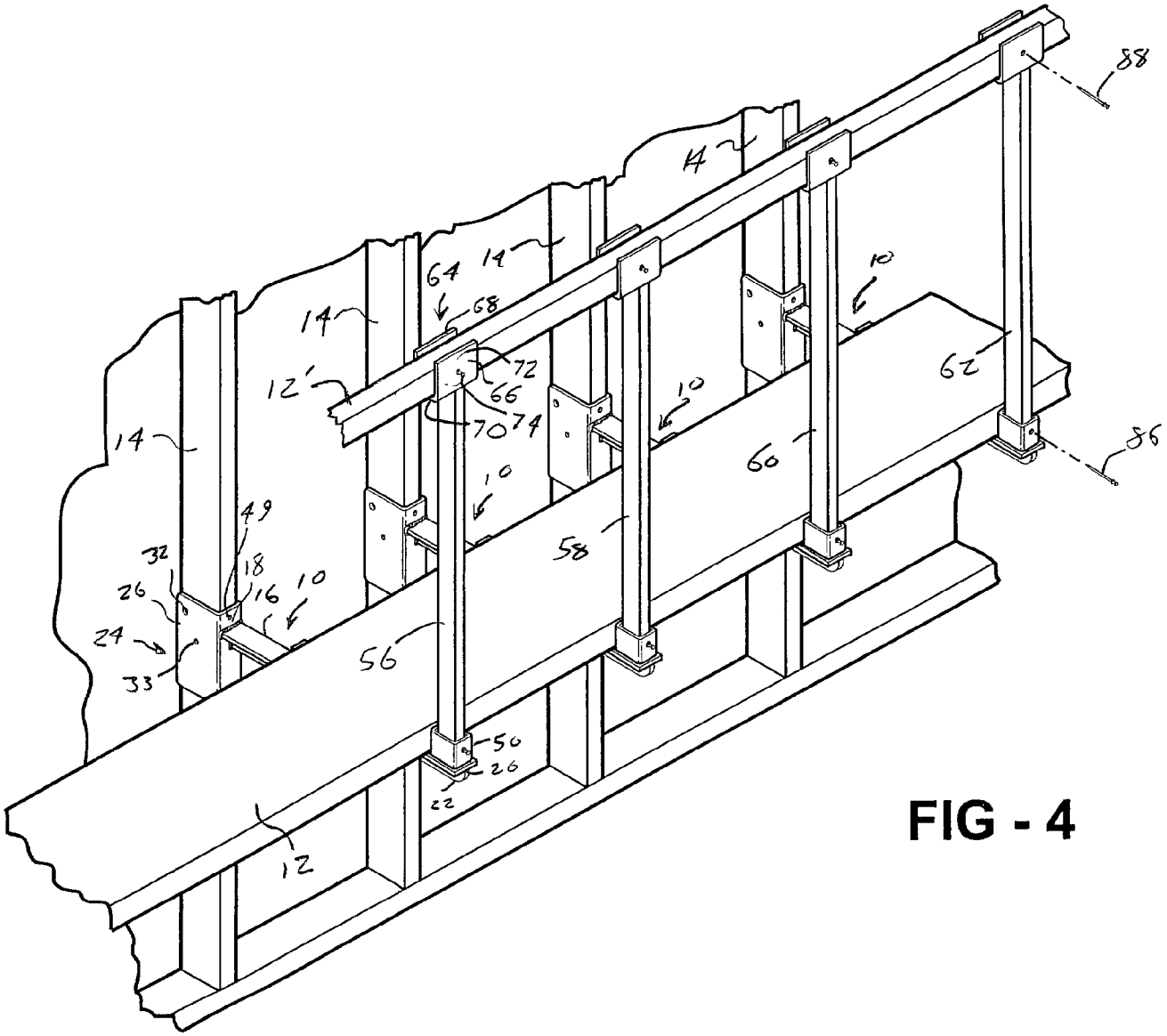
FIG. 4 is an illustration substantially identical to that presented in FIG. 3 and further showing a plurality of hand rail supports secured to associated support brackets and in order to permit the installation of such as a conventional stud in a hand rail application.

Referring now to FIG. 1, a support bracket is illustrated at 10 according to the preferred embodiment of the present invention. As previously stated, the support bracket 10 is employed, in a preferred application and according to any plurality (such as two or more) in order to support such as a walkway plank 12 (such as a conventionally known and elongated length of 2"×12" wooden planking and as is shown in FIGS. 3 and 4). According to any preferred application, and as will be subsequently described in additional detail, each support bracket 10 is affixed in cantilevered supporting fashion at a given vertical location of a conventional wall stud (see at 14 in FIG. 2).

Figure 2:
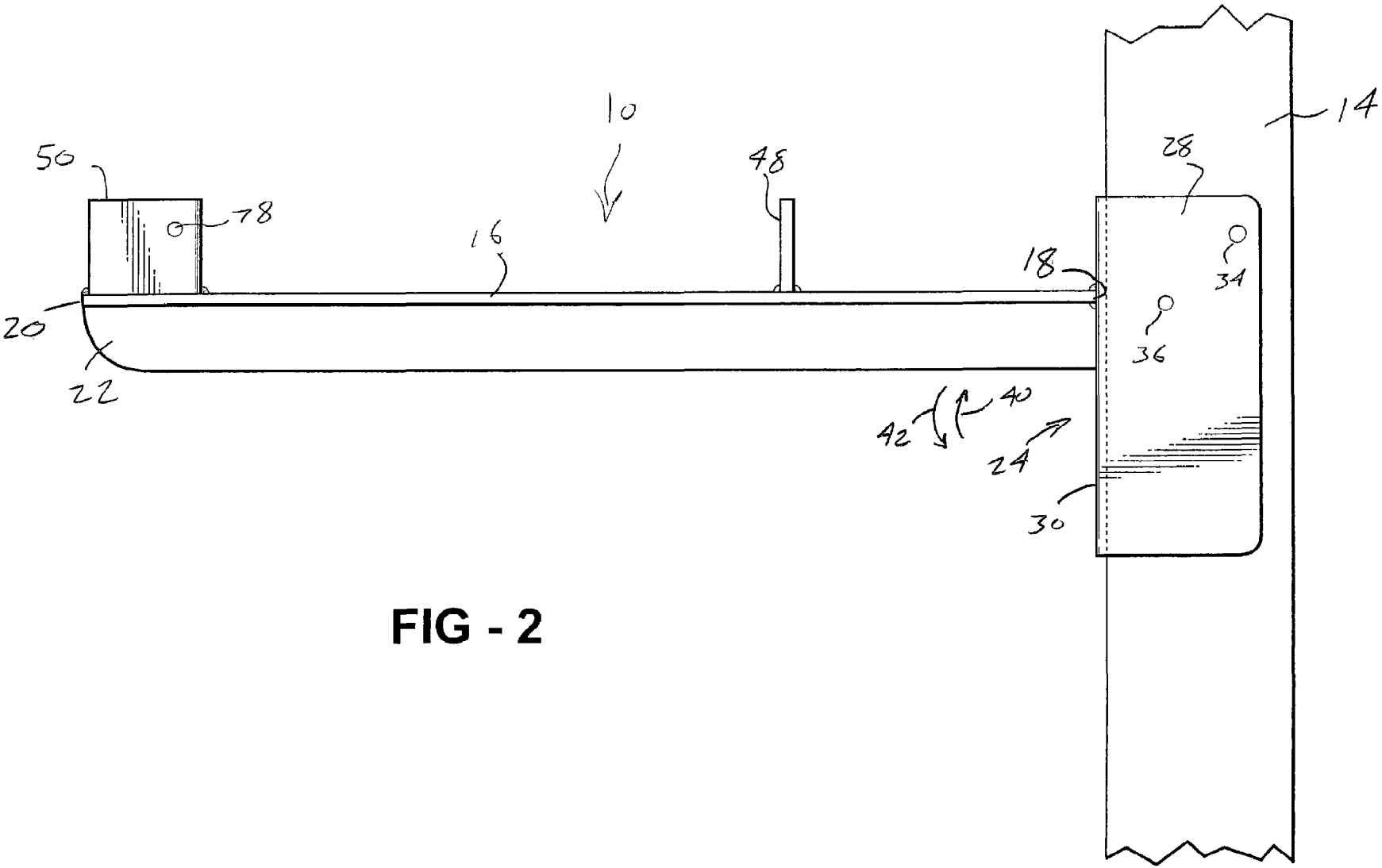
FIG. 2 is a side view of the support bracket shown in FIG. 1 and illustrating the manner in which the channeled base is mounted in cantilever supported fashion and at a desired location to the vertically extending wall stud.

As again best illustrated in the perspective views of FIGS. 1 and 2, each support bracket 10 is constructed of a durable steel or suitable metal material exhibiting the necessary properties of durability and strength and includes an elongated, substantially flattened and reinforced support surface 16 having a first end 18 and a second end 20. In the preferred embodiment, and in order to further strengthen and reinforce the support surface 16, an "I" beam portion 22 projects in substantially perpendicular fashion from an underside surface.

A three dimensional shaped and channeled base 24 extends from the first end 18 of the support surface. As illustrated in FIGS. 1 and 2, and in one preferred application, the channeled base 24 can be welded to the end 18 of the support surface 16, however it is understood that the support bracket 10 can also be produced as a single seamless piece through such as a die casting process.

The channeled base includes first 26 and second 28 spaced apart sides and an interconnecting forward side 30. Defined through each of the first 26 and second 28 sides are aligning apertures, see at 32 for side 26 and at 34 and 36 for side 28 (noting further that a second aperture associated with the first side 26 is hidden from view in FIGS. 1 and 2 but shown at 33 in FIG. 4 is understood to align with the corresponding aperture 36 of second side 28). It is also understood that while only a single fastener/nail 38 is required for effectively mounting the channeled base 24 to the vertical stud location 12, the provision of the additional pair of aligning apertures allows for the installation of another fastener and in order to further strengthen the mounting of the bracket 10 to the stud 12.

As shown in FIG. 1, and upon aligning the sides 26 and 28 in seating fashion over a selected wall stud (see further at 14 in FIG. 2), a mounting fastener 38 (such as a suitable gauge nail) enters through a selected aperture 32 in the first side 26, through the wall stud 14, and exits through the further selected and aligning aperture 34 in the second side 28. In this fashion, the "U" shaped and channeled base provides cantilevered support to the support surface 16, such as is illustrated by curved force direction arrow 40 in FIG. 2 and in turn responsive to opposite arrow 42 which is representative of a weight applied upon the support surface 16.

Referring again to FIG. 1, the selected aperture 34 is sized according to a first diameter, whereas the aligning and further selected aperture 32 is sized according to a smaller diameter. In the preferred application, and as shown in FIG. 1, it is desired to insert the nail (hammer) through the smaller diameter aperture 32, since inevitable misalignments (see directional arrow 44 representing an offset and relative to a straight directional arrow 46) will occur and it is desirous to avoid having to removal and re-nail the fastener 28 as a result of its pointed end not communicating with the secondary aligning aperture 36. As again best shown in FIG. 1, at least one additional aperture 49 may be formed at a suitable location along the interconnecting forward side 30 of the "U" shaped and channeled base and in order to receive a further suitable fastener (nail) to increase the holding force of the channeled base against the stud 14.

A tab 48 is secured in upwardly projecting fashion at a desired intermediate location of the support surface 16. A fitting 50 is secured to an extending end location (proximate second end 20) of the support surface 16 and defines, in combination with the tab, first and second abutment stops creating therebetween a seating area for receiving, in widthwise inserting fashion, the walkway plank 12.

As is again shown in FIGS. 1 and 2, the tab 48 and fitting 50 are each illustrated as being welded to the specified locations of the upper support surface 16, it again being understood that the tab 48 and fitting 50 can be integrally formed during the initial manufacture of the support bracket, such as again occurring in a die casting or other suitable forming operation. It is also understood that the tab 48 can either be removed in favor of a wider (than 2"×12") width of walkway plan seated between the fitting 50 and the abutting surface of the forward facing side 30 of the channeled base. It is also contemplated, although not shown, that an extra length of stud, such as a 2"×6" can be seated between the tab 48 and the side 30 of the channeled base and, in combination with the 2"×12" walkway plank, to provide a widened walkway.

The fitting 50 is generally rectangular shaped and is internally recessed (see at 52 in the perspective of FIG. 1) for receiving, in vertically seating fashion, a lower inserting end 54 of an elongated rail support 56. A plurality of the rail supports, see at 56, 58, 60, 62, et seq., are illustrated in FIG. 4. Referring again only to the first selected rail support 56 in FIG. 4, it terminates in a channeled rail support portion 64 extending in upwardly extending fashion.

As with the channeled bracket 24, the channeled rail support portion 64 (as well as the corresponding support portions associated with each succeeding rail support 58, 60, 62, et seq.) includes first and second spaced apart sides 66 and 68 and an interconnecting base side 70. Apertures are formed in aligning fashion through each of the spaced apart sides 66 and 68 (see at 72 for side 66) and, after receiving in seating fashion a further length of stud 12', a nail fastener 74 is hammered through to secure the stud 12' at the given rail support portion 64 and in combination with each succeeding rail support portion associated with the rail supports 58, 60, 62, et seq.

In this fashion, the stud 12' operates as a hand rail in combination with the walkway plank 12 supported upon the support surface 16 of each associated bracket. Referring again to FIG. 1, pairs of apertures are defined at 76 and 76' and 78 and 78' in each of first and second interconnecting sides of the fitting 50, as well as at 80 and 82 in aligning fashion and with regard to associated sides of the rail support 56. A nail or like fastener 84 (see again FIG. 1) is then installed, such as by hammering, and in order to secure the associated rail support 56 within the fitting 50.

As is also shown in FIG. 4, identical nail fasteners, such as 16 gauge nail shown at 86 and 1¼" roofing nail shown at 88, in association with rail support 62, are hammered into each of the fitting and channeled rail support portion and in order to complete the hand rail installation variant of the support bracket. Referring to FIG. 3, substantially the identical illustration is shown of the application variant of FIG. 4, with the exception that the hand rail supports are not present.

Figure 5:
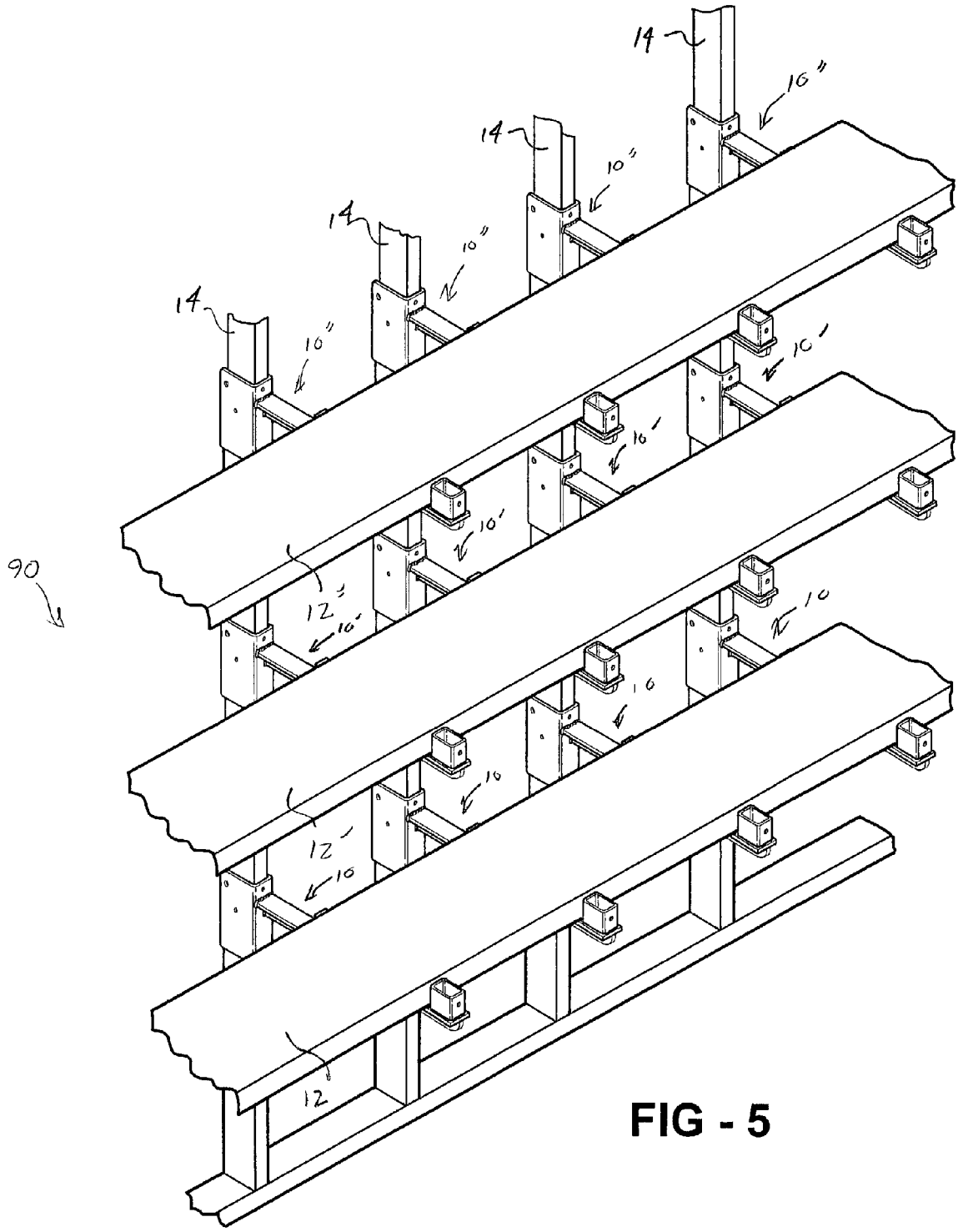
FIG. 5 is an illustration, again in perspective, of a further preferred variant of the present invention and in which pluralities of support brackets are arranged in vertically spaced and level rows in order to provide shelving support.

Referring to FIG. 5, a general illustration is given at 90 of a further application of the present invention and in which pluralities of support brackets, see at 10, 10' and 10" are arranged in vertically spaced and level rows, and in secured fashion to each of a plurality of spaced apart wall studs 14, in order to provide shelving support. Note in particular 2"×12" planks 12, 12' and 12" supported, respectively, in substantially horizontal and associated fashion with each succeeding and vertically spaced apart row of support brackets 10, 10' and 10".

Figure 6:
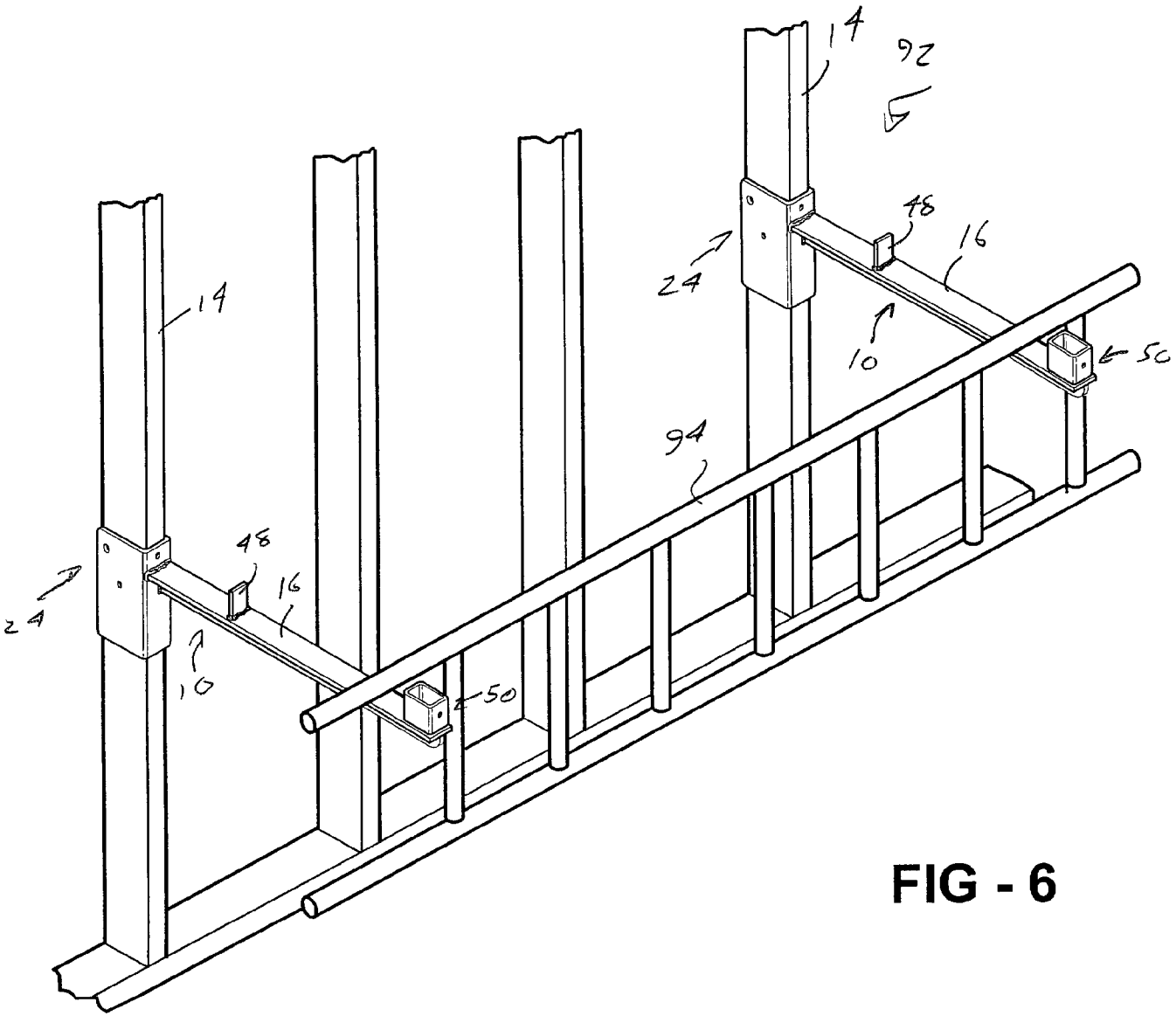
FIG. 6 is a further perspective illustration of a pair of support brackets according to a yet further variant of the present invention and functioning to support a stored ladder.

Referring finally to FIG. 6, a general illustration 92, is given of an identical pair of support brackets 10, secured in substantially vertically aligned fashion to selected and spaced apart wall studs 14 and according to a yet further variant of the present invention. In this application variant, the pair of mounted support brackets 10 function to support a stored ladder 94 at first and second locations and upon the seating areas defined by their upper support surfaces 16.

Having described my invention, additional preferred embodiments will become apparent to those skilled in the art to which it pertains and without deviating from the scope of the appended claims.

I claim:

1. A support bracket for securing to a vertically extending wall stud, said support bracket providing cantilevered support of an elongated and substantially horizontally disposed plank and comprising:

an elongated, substantially flattened and reinforced support surface having a first end and a second end;

a three dimensional shaped and channeled base extending from said first end of said support surface, said channeled base including a forward side and first and second interconnected, spaced apart and substantially downwardly extending sides through which are defined at least a first pair of aligning apertures, upon aligning said sides in seating fashion over a selected wall stud, a mounting fastener enters through a selected aperture in said first side, through the wall stud, and exits through a further selected and aligning aperture in said second side, the positioning of said mounting fastener, in combination with said forward side, providing a sole cantilevered support to said reinforced support surface and in response to weight applied upon said support surface;

a first abutment stop projecting from a first location of said support surface, a second abutment stop projecting from a second spaced apart location and defining, in combination with said first stop, a seating area for receiving, in widthwise inserting fashion, the plank; and at least first and second support brackets securing, respectively, in substantially vertically aligned fashion to a pair of spaced apart wall studs and in order to support, therebetween, the horizontally disposed plank.

2. The support bracket as described in claim 1, said first abutment stop further comprising a tab welded in upwardly projecting fashion from an intermediate location of said support surface.

3. The support bracket as described in claim 2, said second abutment stop further comprising an integrally formed fitting arranged at an extending end location of said support surface.

4. The support bracket as described in claim 3, said fitting being internally recessed for receiving, in vertically seating fashion, an inserting end of an elongated hand rail support.

5. The support bracket as described in claim 4, said hand rail support further comprising a channeled rail support portion for receiving, in seating fashion, a further length of stud.

6. The support bracket as described in claim 4, further comprising at least one additional aperture defined in at least one side of said fitting, a fastener inserting through said aperture and engaging said inserted end of said elongated rail support.

7. The support bracket as described in claim 1, a first selected aligning aperture being sized according to a first diameter, a second selected and aligning aperture being sized according to a second larger diameter.

8. The support bracket as described in claim 1, said channeled base further comprising an interconnecting side disposed between said first and second spaced apart sides, at least one additional aperture being defined in said interconnecting side.

9. The support bracket as described in claim 1, said elongated and reinforced support surface further comprising a perpendicular projecting and elongate extending "I" beam portion.

10. A support bracket for securing to a vertically extending wall stud, said support bracket providing cantilevered support of an elongated and substantially horizontally disposed plank and comprising:

an elongated, substantially flattened and reinforced support surface having a first end and a second end;

a three dimensional shaped and channeled base extending from said first end of said support surface, said channeled base including a forward side and first and second interconnected spaced apart and substantially downwardly extending sides through which are defined at least a first pair of aligning apertures, upon aligning said sides in seating fashion over a selected wall stud, a mounting fastener enters through a selected aperture in said first side, through the wall stud, and exists through a further selected and aligning aperture in said second side, the positioning of said mounting fastener, in combination with said forward side, providing a sole cantilevered support to said reinforced support surface and in response to weight applied upon said support surface;

a tab secured to said support surface and in upwardly projecting fashion from a first intermediate location, a fitting secured to an extending end location of said support surface and defining, in combination with said tab, a seating area for receiving, in widthwise inserting fashion, the plank;

said fitting being internally recessed for receiving, in vertically seating fashion, an inserting end of an elongated rail support, said rail support further comprising a channeled rail support portion for receiving, in seating fashion, a further length of stud operating as a hand rail; and at least first and second support brackets securing, respectively, in substantially vertically aligned fashion to a pair of spaced apart wall studs and in order to support, therebetween, the horizontally disposed walkway plank and hand rail.

11. The support bracket as described in claim 1, further comprising a second pair of aligning apertures formed through said first and second spaced apart sides of said channeled base and in spaced apart fashion from said first pair of aligning apertures.

12. The support bracket as described in claim 6, said internally recessed fitting exhibiting a substantially rectangular configuration, a first pair of aligning apertures being formed through first and second walls of said fitting, a second pair of aligning aperture being formed through third and fourth interconnecting walls of said fitting, first and second fasteners inserting through said pairs of aligning apertures in crosswise extending fashion.

13. The support bracket as described in claim 12, further comprising first and second apertures formed in cross wise extending fashion through said inserting end of said rail support and which align with said first and second pairs of aligning apertures in said recessed fitting.

* * * * *